US006126037A

United States Patent [19]

Lifshey

[11] Patent Number: 6,126,037

[45] Date of Patent: Oct. 3, 2000

[54] FLOW CONTROL ORIFICE

[75] Inventor: Arthur L. Lifshey, East Brunswick, N.J.

[73] Assignee: Merck & Co., Inc., Rahway, N.J.

[21] Appl. No.: 09/138,506

[22] Filed: Aug. 24, 1998

Related U.S. Application Data

[60] Provisional application No. 60/058,220, Sep. 9, 1997.

[51] Int. Cl.[7] ..... B67B 7/00

[52] U.S. Cl. ..... 222/1; 222/83; 222/83.5

[58] Field of Search ..... 222/83, 83.5, 88, 222/420, 546, 541.2, 1

[56] References Cited

U.S. PATENT DOCUMENTS

| | | | |
|---|---|---|---|
| 4,888,015 | 12/1989 | Domino | 623/6 |
| 4,904,649 | 2/1990 | Schwartz | 514/174 |
| 5,042,690 | 8/1991 | O'Meara | 222/83 |
| 5,301,837 | 4/1994 | O'Meara | 222/83 |
| 5,624,057 | 4/1997 | Lifshey | 222/541.2 |
| 5,648,084 | 7/1997 | Guttag | 424/405 |
| 5,789,435 | 8/1998 | Harris et al. | 514/439 |

FOREIGN PATENT DOCUMENTS

| | | |
|---|---|---|
| 2 020 255 | 11/1979 | United Kingdom . |
| 2 222 153 | 2/1990 | United Kingdom . |
| WO 91/12198 | 8/1991 | WIPO . |
| WO 95/20532 | 8/1995 | WIPO . |
| WO 97/00816 | 1/1997 | WIPO . |

*Primary Examiner*—Henry J. Recla
*Assistant Examiner*—Khoa D. Huynh
*Attorney, Agent, or Firm*—Elliott Korsen; Mark R. Daniel

[57] ABSTRACT

An improved process of creating a uniform puncture in a medication dispenser bottle utilizes a membrane within the tip of the dispenser which is punctured with the hole being of a controlled, uniform size. The size of the hole is controlled by a mechanical stop created by shoulders integral to the base of the puncturing member.

4 Claims, 2 Drawing Sheets

FLOW CONTROL ORIFICE

This application claims the benefit of U.S. Provisional Application No. 60/058,220, filed Sep. 9, 1997.

BACKGROUND OF THE INVENTION

This invention relates to a method of creating a controlled sized flow controlling orifice for an ophthalmic dispensing tip or other type of dispenser requiring the dispensing of a controlled volume.

The process of this invention relates to a mechanical means for controlling the size of a punctured orifice in a molded plastic membrane. In particular, this process is applicable for use with an eye dropper or other type of ophthalmic dispensing device.

It is difficult to manufacture a dispensing device which will create a uniformly punctured orifice when operated. Without a uniform puncture, the size of the orifice can vary resulting in different sized droplets coming from the dispensing device. When a uniform volume of drop is required for therapeutic reasons, it is often difficult to control the device and dispense the desired amount. Without such control, the size of the punctured orifice could vary greatly depending upon molding and assembly tolerances in the mechanical means used to create the linear motion of the puncturing member.

SUMMARY OF THE INVENTION

There is disclosed a method for producing a uniform controlled flow orifice in the tip of a medication dispenser, said dispenser having a cap assembly and medication container, which comprises puncturing an intact molded plastic membrane within said tip with a pointed puncturing member contained within the cap assembly of said dispenser.

DETAILED DESCRIPTION OF THE INVENTION

There is disclosed a method for producing a uniform controlled flow orifice in the tip of a medication dispenser, said dispenser having a cap assembly and medication container, which comprises puncturing an intact molded plastic membrane within said tip with a pointed puncturing member contained within the cap assembly of said dispenser.

In particular, there is disclosed a means for controlling the size of an orifice in a dropper tip in a container for dispensing liquid medicaments such as eye or ear drops. Examples of such eye drops include, but are not limited to, TRUSOPT, TIMOPTIC, TIMOPTIC XE, COSOPT, CHIBROXIN, DECADRON or NEODECADRON.

The molded plastic membrane is within the tip of a dispensing device such as the ophthalmic dispensing device disclosed in U.S. Pat. No. 5,624,057 which issued Apr. 29, 1997. The puncturing tip is part of a piercing container cap as disclosed in U.S. Ser. No. 08/729,974 filed Oct. 15, 1996.

Figure 1:
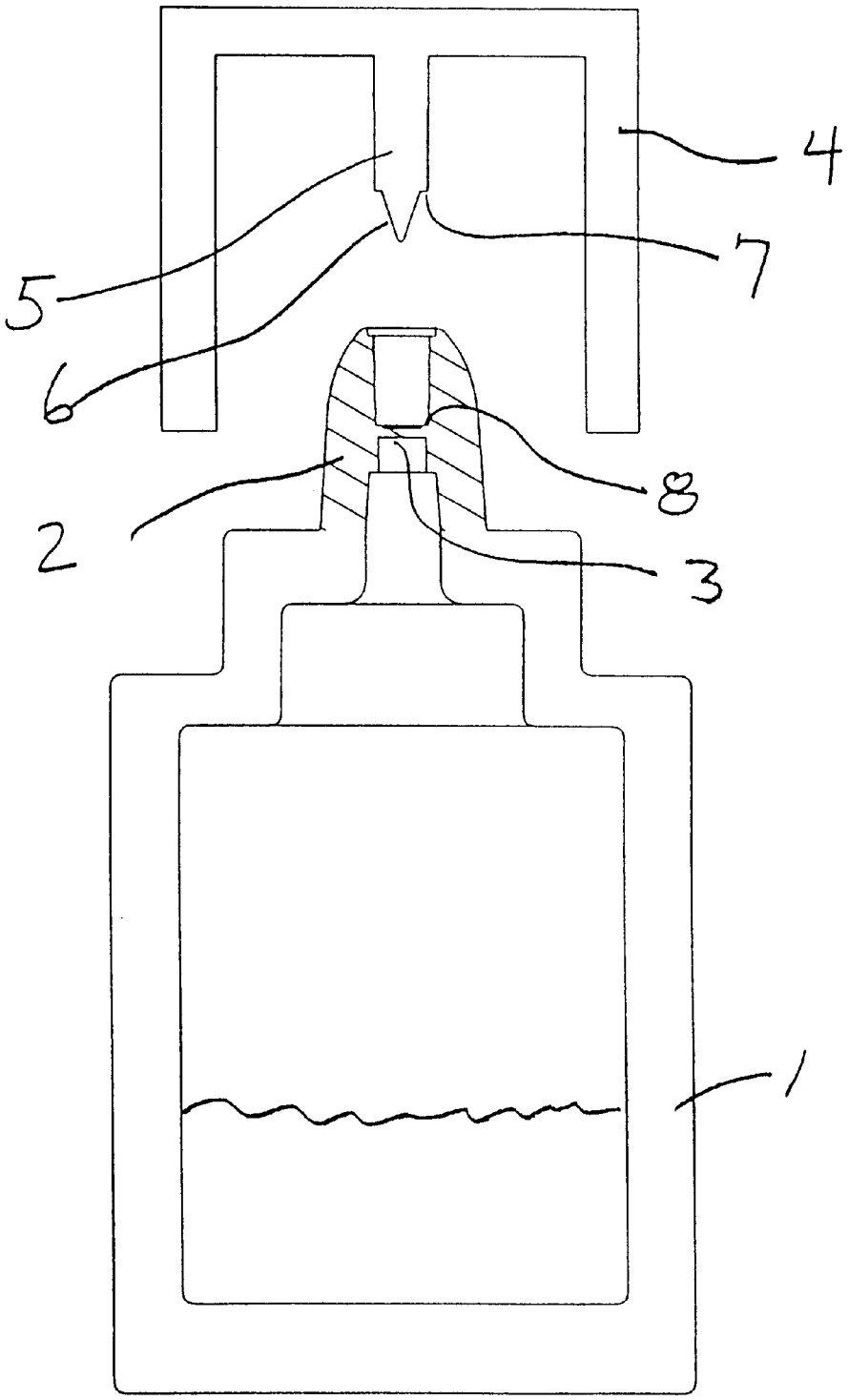
FIG. 1 is a cross-sectional view of a bottle containing liquid medication, hermetically sealed by a bottom closure and a molded membrane within the dispensing dropper tip. Also shown, but not yet affixed to the bottle is the closure cap which has within it a sharp, conical puncturing member.

Referring now to the drawings where like numerals represent like elements throughout various views. FIG. 1 shows a cross-sectional view of the bottle (1) containing a liquid medication such as eye drops. The bottle is preferably molded from a suitable thermoplastic resin such as polyethylene or polypropylene. A feature of the bottle is an integrally molded dropper tip (2) which has a relatively thin plastic membrane (3) molded as part of the tip. The thin membrane, along with the bottom seal of the bottle, creates a hermetic seal in the bottle. The thickness of the membrane is such that it can be readily punctured by a properly shaped sharp member composed of plastic or other suitable materials. In the preferred embodiment, the typical thickness of the membrane ranges from 0.1 mm to 1.0 mm depending upon the size of the bottle and materials of construction. The membrane may also be variable in wall thickness in order to control the shape and flow characteristics of the final puncture.

Also shown in FIG. I is the closure cap (4) which has within it a puncturing member (5) which has a sharp conical point (6) of a specific included angle and point radius suitable to puncture the membrane. In a preferred embodiment, the included angle ranges from 20° to 80° and the point radius ranges from 0.05 mm to 0.50 mm. There also exists a puncturing member stop shoulder (7) at the base of the sharp conical point (6). The stop shoulder is of a similar size and shape to contact and mechanically mate with a dropper tip stop shoulder (8) in the molded bottle (1).

Figures 2A, 2B, 2C, 2D:
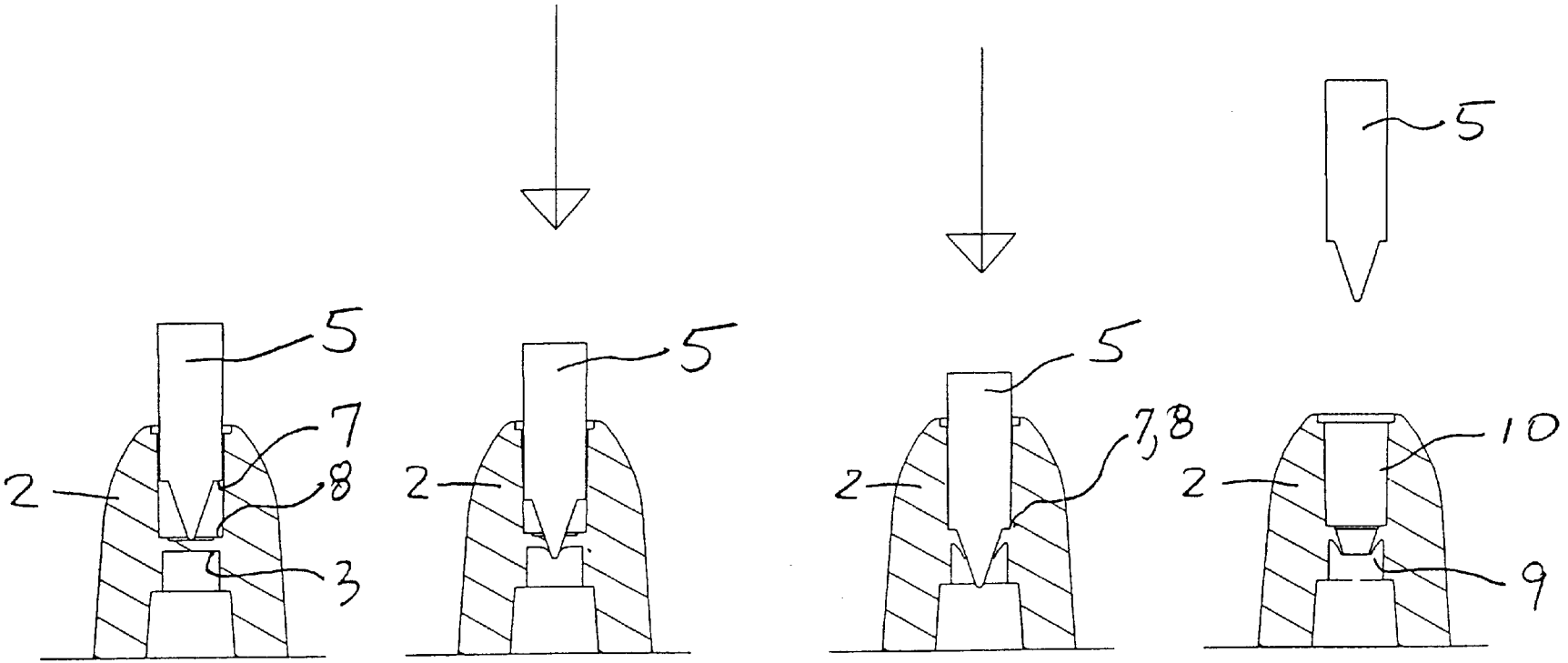
FIG. 2*a* is a view of the puncturing member in place prior to the creation of the orifice.
FIG. 2*b* is a view of the relationship between the puncturing member and the dropper tip as the puncturing of the membrane is in progress.
FIG. 2*c* shows the relationship of the puncturing member and the dropper tip as the membrane becomes fully punctured.
FIG. 2*d* is a view of the dropper tip after the puncturing is complete, and the cap is removed from the bottle tip.

FIG. 2*a* is a view of the puncturing member (5) prior to the creation of the orifice. In this figure, the membrane (3) remains undisturbed and continues to provide an hermetic seal for the contents to of the container.

FIG. 2*b* is a view of the relationship between the puncturing member (5) and the dropper tip (2) during puncturing of the membrane (3).

FIG. 2*c* shows the relationship of the puncturing member (5) and the dropper tip (2) as the membrane (3) becomes fully punctured. It is important to note that further downward movement of the puncturing member is restricted since the puncturing member stop shoulder (7) comes into contact with the corresponding dropper tip stop shoulder (8) The result is a uniform size puncture.

FIG. 2*d* is a view of the dropper tip after the puncturing is complete, and the cap is removed from the bottle. There is now formed into the membrane a tapered opening (9) directly related to the size, shape, and depth of penetration of the puncturing member. In most plastic materials contemplated for this invention, one would expect some permanent deformation or elongation of the membrane during the puncturing process, and some small recovery of the deformation after said removal of the puncturing member from the dropper tip.

The piercing member, while shown conical in shape, can be any shape suitable to puncture the membrane desired to be opened. The internal canal (10) and tapered puncture (9) are self cleaning as the cap is reinstalled onto the bottle. If there is remaining residual liquid medication or solid precipitate left in the internal canal (10) or in the tapered opening (9), it will be displaced back into the container by the ram action of the puncturing member (5) reentering the bottle (2). The residual liquid medication will mix with the medication already in the bottle and any solid residual can again go into solution, thus leaving the dispensing tip free and clear for the next dispensing of medicated drops.

Another feature of this application is that the shape of the tapered opening (9) forming the controlled flow orifice is of such a geometry that it results in greater flow resistance to drops being dispensed from the tip than to drop being sucked back into the bottle. This provides the desirable combination of flow control to minimize the tendency for multiple drop dispensing, yet encourages desirable suckback of unused medication, mininizing wasted drops and wetting of the external surfaces of the dropper tip after expulsion of a single drop. Reinstallation of the cap also creates a relatively high pressure seal which prevents leakage of fluid from the bottle during the usage period.

While the preferred embodiments of the invention have been described in detail, modifications and adaptations may be made thereto without departing from the spirit and scope of the invention.

What is claimed is:

1. A method for producing a uniform controlled flow orifice in a dropper tip of a medication dispenser which comprises a) puncturing an intact molded plastic membrane having a peripheral edge and located in the top of said medication dispenser with a conical puncturing member contained within the cap assembly of said dispenser, by turning the cap of said medication dispenser causing the downward movement of said puncturing member;

b) the downward movement of said puncturing member being restricted by shoulder stops, one adjacent said peripheral edge and the other adjacent said puncturing member which upon the downward movement of said member punctures the intact membrane creating an orifice; and c) the depth and shape of said orifice being restricted by the contact of said shoulder stops.

2. The method of claim 1 wherein the dispenser is used to store a medicament.

3. The method of claim 2 wherein the medicament is an eye drop.

4. The method of claim 1 wherein the puncturing member provides a self-cleaning mechanism by pushing excess liquid retained in the internal canal of the dropper tip back into the bottle of the dispenser.

* * * * *